US006077167A

United States Patent [19]

Ciniello

[11] Patent Number: 6,077,167

[45] Date of Patent: Jun. 20, 2000

[54] BOWLING GAME APPARATUS AND METHOD

[75] Inventor: Patrick Ciniello, Bonita Springs, Fla.

[73] Assignee: Qubica USA, Bonita Springs, Fla.

[21] Appl. No.: 09/296,036

[22] Filed: Apr. 21, 1999

Related U.S. Application Data

[60] Provisional application No. 60/083,635, Apr. 30, 1998.

[51] Int. Cl.[7] ..... A63D 5/04

[52] U.S. Cl. ..... 473/54; 473/58; 473/70

[58] Field of Search ..... 473/54, 58, 64, 473/65, 70, 71, 72, 101

[56] References Cited

U.S. PATENT DOCUMENTS

| | | |
|---|---|---|
| 2,194,830 | 3/1940 | Koci . |
| 2,223,255 | 11/1940 | Koci . |
| 2,931,656 | 4/1960 | Hooker . |
| 2,990,177 | 6/1961 | Hutchison . |
| 3,051,485 | 8/1962 | Heilbrun . |
| 3,063,719 | 11/1962 | Rosenberger . |
| 3,082,000 | 3/1963 | Holcombe . |
| 3,120,956 | 2/1964 | Burgess . |
| 3,140,872 | 7/1964 | Bolger, Jr. . |
| 3,145,025 | 8/1964 | Morrison et al. . |
| 3,212,779 | 10/1965 | Gruss et al. . |
| 3,301,558 | 1/1967 | Clapham . |
| 3,310,659 | 3/1967 | Apostle et al. . |
| 3,651,328 | 3/1972 | Mahoney . |
| 3,781,009 | 12/1973 | Gagnon . |
| 4,247,100 | 1/1981 | Barbee . |
| 4,269,415 | 5/1981 | Thorne-Booth . |
| 4,339,128 | 7/1982 | Multner . |
| 4,884,806 | 12/1989 | Brim . |
| 5,241,379 | 8/1993 | Tsujita . |
| 5,683,302 | 11/1997 | Harrell et al. . |
| 5,713,798 | 2/1998 | Brodie, Jr. . |

*Primary Examiner*—William M. Pierce
*Attorney, Agent, or Firm*—Allen, Dyer, Doppelt, Milbrath & Gilchrist, P.A.

[57] ABSTRACT

A bowling game enhances the traditional scoring of a strike or a spare when the bowler is able to time the rolling of the ball by a preselected location on the lane with a preselected location of an image being scanned transversely across the lane. The game uses a laser beam for illuminating a series of images in the form of spots of light, and in a sequencing fashion, moves the spots of light across the lane for viewing by the bowler during the rolling of the bowling ball towards standing pins. A sensor is positioned at a preselected location along side the lane for determining when the ball reaches the predetermined location. A processor provides an enhanced scoring to the otherwise traditional scoring when the ball reaches the preselected location at the same time a particular preselected spot of light reaches a particular location on the lane. By way of example, a bowler attempts to have the bowling ball pass the predetermined location on the lane when a preselected spot of light is illuminated, and if successful, the scoring of a strike or a spare will be enhanced as a result of the timing of the ball with the moving spots of light. Various locations on the lane are assigned enhancing values for adding to the score of the bowling game.

46 Claims, 4 Drawing Sheets

BOWLING GAME APPARATUS AND METHOD

CROSS REFERENCE TO RELATED APPLICATION

This application for patent is related to and claims the benefit of pending Provisional Application Ser. No. 60/083,635 filed on Apr. 30, 1998, the disclosure of which is herein incorporated by reference.

FIELD OF THE INVENTION

The invention relates to the sport of bowling and, in particular, to scoring in a game based on the position of a bowling ball prior to striking the standing pins.

BACKGROUND OF THE INVENTION

Conventional bowling games, ten pin bowling by way of example, includes the player throwing a first ball in an attempt to knock down ten standing pins. If successful, a strike is declared and appropriately scored. If after throwing the first ball, pins remain standing, a second attempt is made and if the remaining pins standing are knocked down, a spare is declared and appropriately scored. Although the trajectory of a ball typically determines the success in knocking down pins, different players will have different trajectories of preference. With the ever increasing exposure to interactive computer games and competitive sporting activities, it is well known in the bowling industry that there is a need for enhanced enjoyment from the traditional game of bowing.

SUMMARY OF THE INVENTION

In view of the foregoing background, it is therefore an object of the present invention to enhancing the scoring in the game of bowling. It is further an object to enhance the scoring during strikes and spares based on the timing with which the ball is rolled along the lane where it ultimately knocks down standing pins.

These and other objects, advantages and features of the present invention are provided by an apparatus illuminating means for illuminating a series of images in a sequencing fashion for viewing by a player during the rolling of the bowling ball towards standing pins, sensing means for sensing the bowling ball at a predetermined location, and a processor operable with the illuminating means and the sensing means for enhancing a bowling score responsive to pins felled by the bowling ball, the processor responsive to the bowling ball being at the predetermined location in combination with an image of the series of images being illuminated for enhancing the scoring of the game based on a preselected combination of values for each image of the series of images. In a preferred embodiment, the illuminating means comprise a light source projecting the series of images as a plurality of spots of light on a surface of the lane, and switching means operable with the light source for illuminating the surface with the spots of light in the sequencing fashion.

A method aspect of the invention includes illuminating a series of images in a sequencing fashion for viewing by a player during the rolling of the bowling ball towards standing pins, sensing the bowling ball at a predetermined location, and enhancing a bowling score responsive to the bowling ball being at the predetermined location when one of the series of images is illuminated, the enhancing based on a preselected combination of values for each position of the series of images on the lane. In one embodiment, a player attempts to have the bowling ball pass the predetermined location on the lane when a preselected spot of light is illuminated. By way of example, if the player is successful, the traditional scoring of a strike or a spare will be enhanced as a result of the timing of the ball with the moving spots of light and an illumination of a particular spot.

BRIEF DESCRIPTION OF DRAWINGS

A preferred embodiment of the invention, as well as alternate embodiments are described, by way of example, with reference to the accompanying drawings in which.

DETAIL DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will more fully convey the scope of the invention to those skilled in the art.

Figure 1:
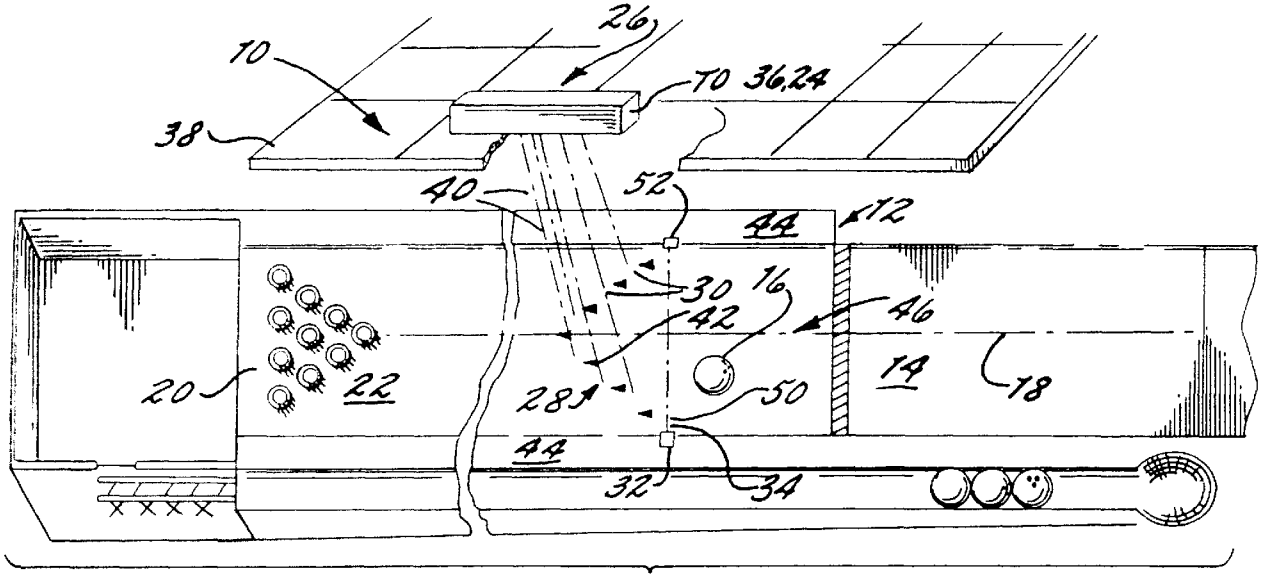
FIG. 1 is a top perspective view of the bowling game apparatus of the present invention.

Referring initially to FIG. 1, an apparatus 10 useful in a game of bowling is illustrated, by way of example, with reference to a bowling lane 12 having an approach area 14 at one end for permitting a player to roll a bowling ball 16 along a longitudinal axis 18 of the lane toward a plurality of standing pins 20 positioned in a predetermined array on a pin deck 22 at an opposing end of the lane, and a scoring system 24 for scoring the game based on an amount pins felled by the bowling ball. As illustrated with reference to FIG. 2, and again to FIG. 1, the apparatus 10 includes a laser module 26 as illuminating means for illuminating a 30 series of images 28 in a transversely sequencing fashion across the lane 12 for viewing by the player during the rolling of the bowling ball 16 toward the standing pins 20. In a preferred embodiment, the images 28 comprise spots of light 30 wherein the laser module 26 is operated to sequentially turn each of the spots of light on and off in a pattern that appears to have the a spot travel toward the center of the lane and then away from the center of the lane toward the side of the lane. A ball sensor 32 is operable at a predetermined position 34 along the side of the lane 12 for sensing the bowling ball 16 as it reaches the predetermined position. A processor 36 is operable with the scoring system 24 and receives signals from the laser module 26 and the ball sensor 32 for determining when and at what amount a bowling score should be enhanced.

As illustrated again with reference to FIG. 1, a preferred embodiment includes the laser module 26 suspended above a dropped ceiling 38 of the bowling alley for directing laser beams 40 downwardly onto the surface of the lane 12 at predetermined locations for the spots of light 30. In one preferred embodiment, eight spots of light 30 are placed proximate and generally adjacent the seven arrows 42 typically found on the surface of the lane 12. As illustrated with reference again to the diagram of FIG. 2, the laser module 26 directs the laser beams 40 in a sequencing fashion to illuminate the spots 18 on the lane surface. In one embodiment of the present invention, a sequence will include illuminating pairs of lights, such as pairs 4-3-2-1 from the left and right sides 44 of the lane toward the center 46, as illustrated by the direction of chase arrow 48. Depending on the game selected, or the skill level of the player, the timing for such sequencing will be varied.

With regard to the ball sensor 32, and as illustrated with reference again to FIG. 1, the sensor includes a light beam 50 directed toward a reflector 52, which operates with a receiver for providing a ball sensing signal 54 when the beam 50 is broken by the passing ball 16. In one embodiment, the a processor 36 is programmed for providing a sequencing signal 56 to the laser module 26 and receives the ball sensing signal 54 from the sensor 32. With the teaching of the present invention, alternate embodiment will come to mind to those skilled in the art. In the embodiment, herein described, the processor 36 provides switching of the light source for triggering the light source in an on and off manner for illuminating the lane with the spots of light in the sequencing fashion. An independent triggering module can be employed.

Figure 3:
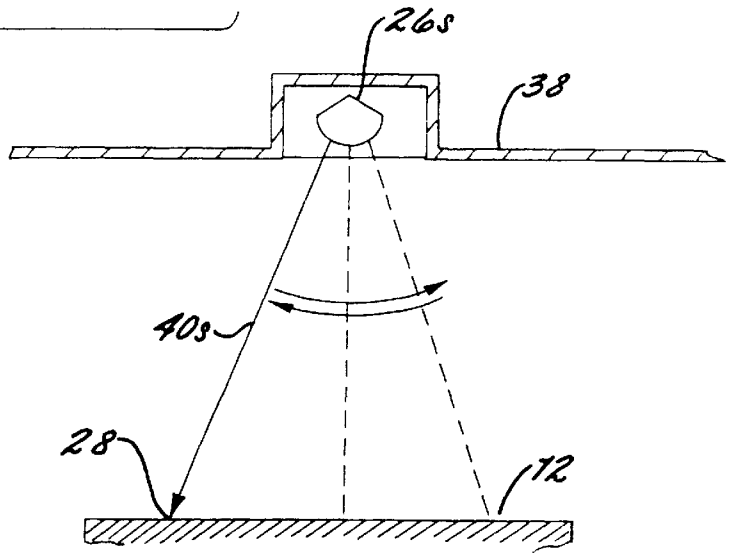
FIG. 3 is a partial cross-section view of an alternate embodiment of the present invention.
Figure 4:
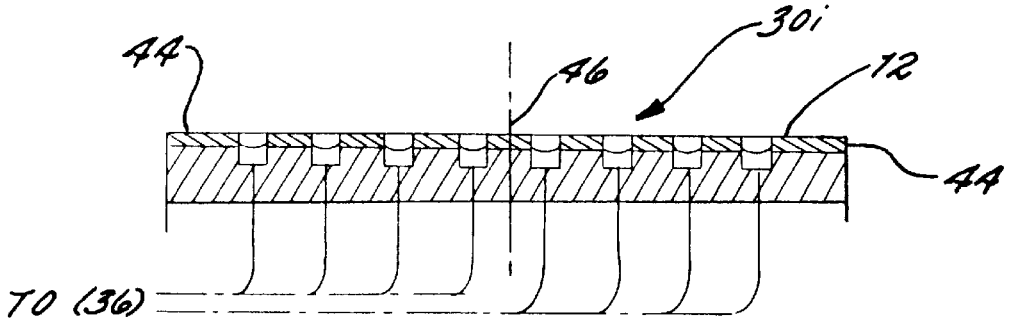
FIG. 4 is a partial cross-section view of yet another embodiment of the present invention.
Figure 5:
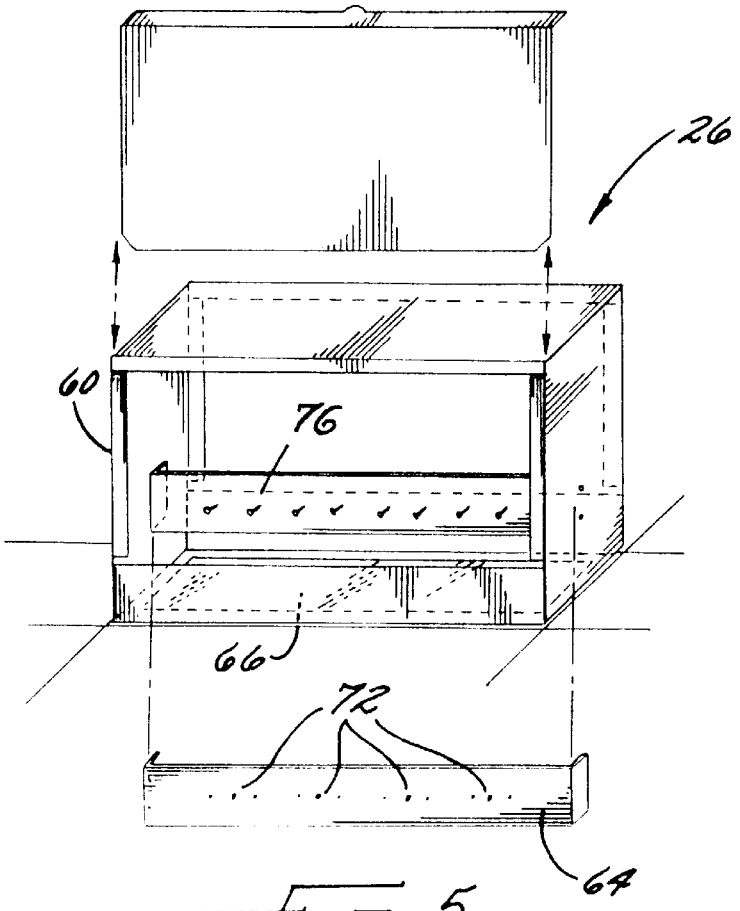
FIG. 5 is an exploded partial perspective view of a laser module housing of the present invention.
Figure 6A:
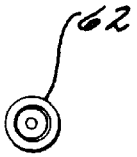
FIGS. 6A and 6B are end and side views respectively of a laser sources used within an embodiment of the present invention.
Figure 6B:
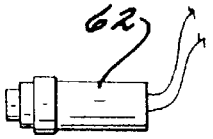
Figure 7A:
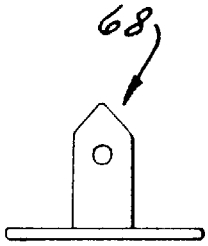
FIGS. 7A through 7C are left side, top plan, and right side views respectively of a mount.
Figure 7B:
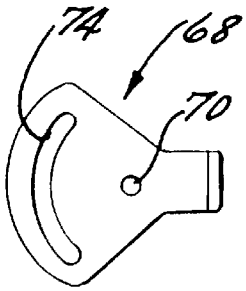
Figure 7C:
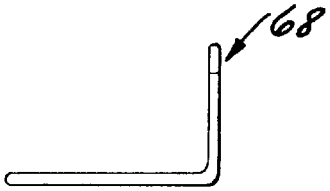

Further, and as illustrated with reference to FIG. 3, in an alternate embodiment, a scanning laser source 26*s* provides a laser beam 40*s* scanned across the lane 12 to provide the series of images 28 as spots moving transversely across the lane. In yet another embodiment, as illustrated with reference to FIG. 4, a plurality of light sources 30*i* are imbedded in the lane 12. The plurality of light sources 30*i* extend transversely across the lane 12. Switching of the plurality of light source 30*i* is provided by the processor 36 operable with each of the plurality of the light sources 30*i* for triggering each in an on and off manner for illuminating the lane 12 with the series of images 28 in the earlier described sequencing fashion.

Figure 2:
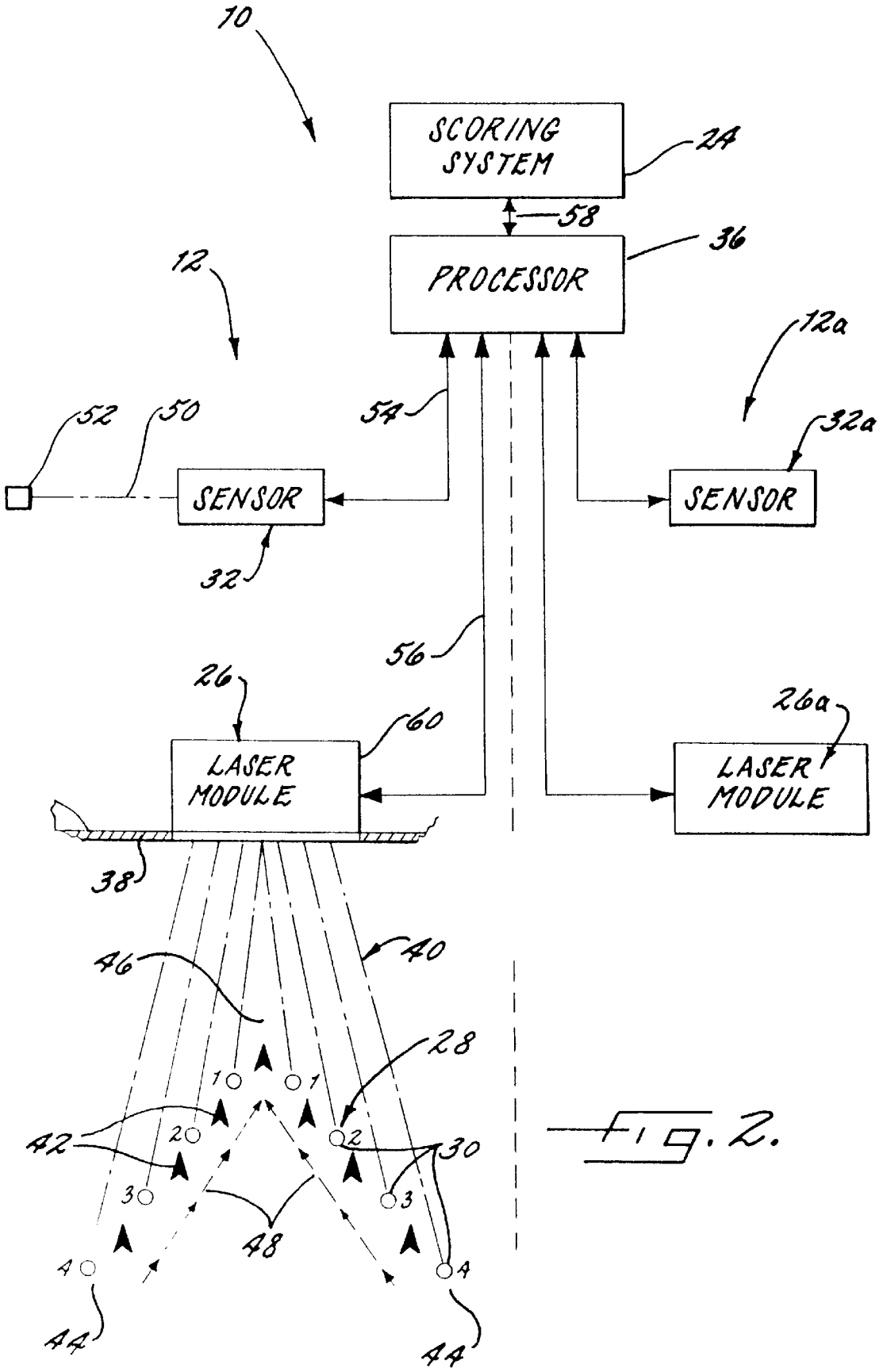
FIG. 2 is a block diagram illustrating elements of an embodiment of the apparatus of FIG. 1.

As further illustrated with reference to FIG. 2, the processor 34, in a preferred embodiment of the present invention, operates with a second sensor 32*a* and a second laser module 26*a* of an adjoining lane 12*a*. Operation of the processor 36, sensors 32, 32*a*, and laser modules 26, 26*a* are through three and five conductor wires using low voltage signal and signal processing. Control of the processor 36 as well as data signals 58 generated by the processor communicates with the scoring system 24 of an existing bowling alley or an independent unit as will be determined for the circumstances demanded.

As illustrated with reference to FIGS. 5, 6A, 6B, and 7A through 7C, the laser module 26, in one economic embodiment comprises a housing 60 with eight laser sources 62 mounted on a bracket 64, carried within the housing. A bottom wall 66 of the housing 60 is transparent to permit passing of the laser beams 40 therethrough. In a preferred embodiment of the present invention, eight spots of light 30 are directed by eight laser sources 62 onto the surface of the lane 12 as earlier described with reference to FIGS. 1 and 2. As illustrated with reference again to FIGS. 7A through 7C, mounts 68 for each of the laser sources 62 are rotatably mounted to the bracket 64 and fixed for directing each laser beam to the desired locations on the surface of the lane. A pivot hole 70 for receiving a pin and pivoting about holes 72 within the bracket 64 are provided. In addition, a slotted hole 74 cooperates with a locking screw 76 for securing the mount 68 in a preselected position for directing the laser beams 40.

Figure 8:
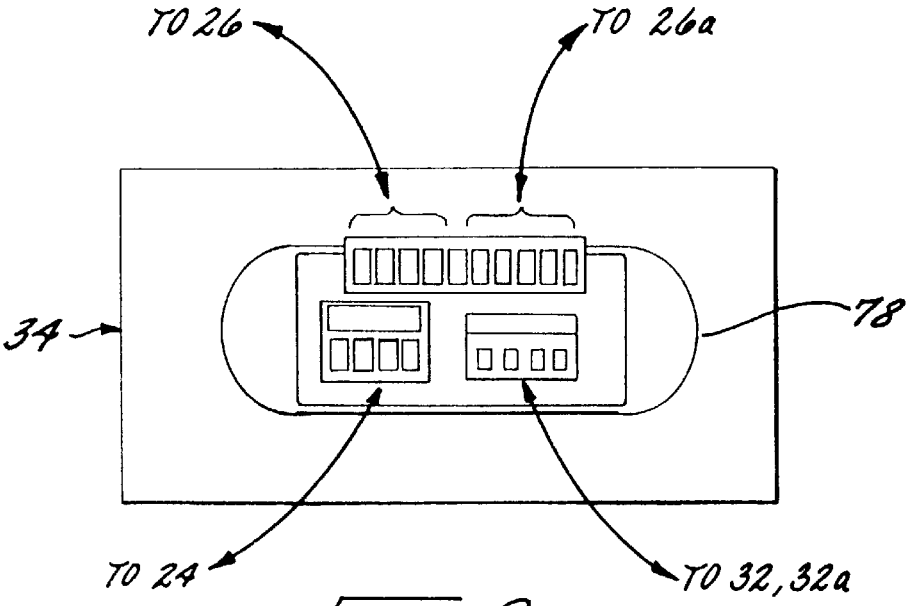
FIG. 8 is a partial front view of a connector interface of the present invention.

By way of further example, and with reference to FIG. 8, the processor 34 includes an interface 78 for connecting signal wiring to and from the scoring system 24. As a convenience to an installer, the interface 78 includes connector for providing signal processing between the processor 36 and the sensor 32, laser module 26, and scoring system 24. The interface 78 provides low voltage signal connection as well as power connection to the various elements within the apparatus 10. By way of example, a pair of lanes 12, 12*a* in a scoring system, may be made up of several electronic devices, including a VDB, T-Vision, Six Box, and Bowler Terminal Board. Monitors and bowler key pads are also included. The VDB is a main control and graphic unit. The T-Vision is a unit that controls the speed, triggers the sensors, and a camera. The Six Box is a pin setter/pin spotter interface, and the Bowler Terminal Board is an interface to the bowler key pads. The electronics for various games played with these devices are connected to a four conductor cable, as referred to as L-COM. Two of these four connectors are a low voltage power supply, generated by the VDB and used by any other device connected to the L-COM. The other two wires are communication wires used by the various devices on the L-COM to send and receive information. Such components are anticipated for use in the above-described apparatus 10.

Figure 9:
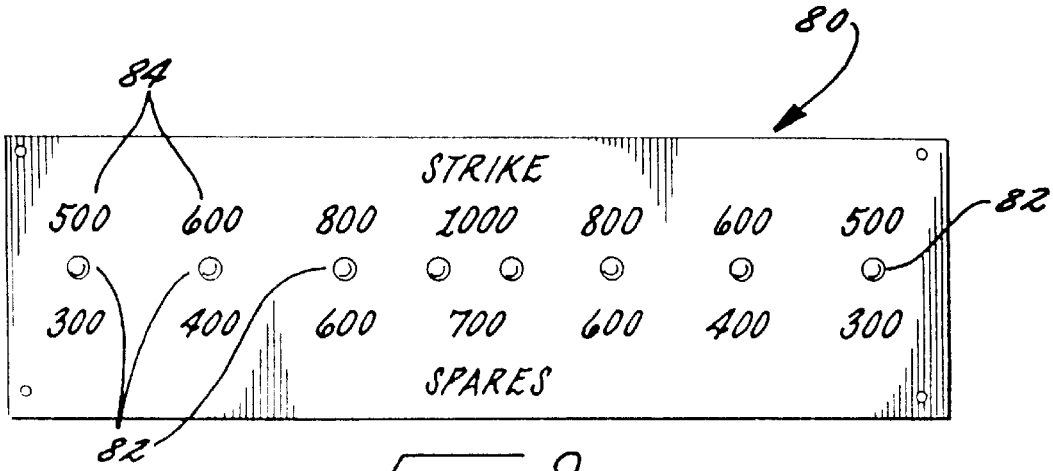
FIG. 9 is a display panel, illustrating scoring and lighting associated with the operation of the apparatus of the present invention.

As earlier described, the processor 36 is responsive to a ball sensing signal 54 from the ball sensor 32 when the bowling ball 16 is at the predetermined location 34 and when a sequencing signal 56 identifies a predetermined spot of light to be illuminated. With such a condition, the processor 36 provides the data signal 58 to the scoring system 24 for enhancing the scoring of the game based on a preselected combination of values for each position of the series of images 28 on the lane 12. As illustrated with reference to FIG. 9, a display 80 is provided that includes a series of display lights 82 representative of the series of images 28, earlier described with reference to FIGS. 1 and 2. By way of example for one embodiment of the present invention, illumination of each of the series of display lights 82 is correlated with illumination of each of the series of spots of light 30. By way of further example, indicia 84 representative of values assigned to various spots of light 30 are carried by the display 80. The indicia 84 provides the player with a scoring value for each position of the series of images 28 on the lane 12, and thus each of the series of display lights 82 displayed. As illustrated with reference again to FIG. 9, one embodiment of the present invention includes eight lights 82, corresponding to the eight spots of light 30 described earlier with reference to FIG. 1.

During operation of a game, a bowler, the player, will score a higher value for the flashing lights during a strike, as illustrated by the numerals on the display 80. A spare will receive a lower value of flashing lights, as again illustrated with reference to the numerals. Missing a spare will result in a score based on the downed pins only, again by way of example. An alternate embodiment may have the display 80 in convenient view of the bowler without illuminating the spots of light on the lane. The bowler can still attempt to have the ball pass the predetermined location 34 while viewing the display 80.

By way of further example of operation of the apparatus 10, and again with reference to FIG. 1, a player will role the bowling ball 16 in an attempt to have the ball cross the spots of light 30 sequencing across the lane 12 as flashing lights. One game will include attempting to have the ball 16 pass the sensor 32 when the illumination is in the center 46 to achieve the highest score value.

One skill involved is timing in rolling the ball. When the ball passes the sensor 32, the last laser beam illuminating its respective spot will remain in the on-position and indicate a value for a strike or a spare. As earlier described, the light beams and thus spots will progress in a sequence similar to disco lights flashing along the surface of a wall. As a result, the player will learn a pattern of sequencing lights and learn to roll the ball with such timing to have the ball pass the desired location when the lights are sequenced to the center of the lane in order to achieve a high score or value. Again, the light beams are turning off and on for creating what appears to be a moving spot transversely across the lane from the sides to the center. One embodiment includes stopping movement of the light beam that is on when the ball is detected by the sensor.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, but rather the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus useful in a game of bowling, the apparatus comprising:

a bowling lane having an approach area at one end for permitting a player to roll a bowling ball generally longitudinally along a surface of the lane towards a plurality of standing pins positioned in a predetermined array on a pin deck at an opposing end of the lane, and scoring means for scoring a game based on an amount pins felled by a bowling ball;

illuminating means for illuminating a series of images in a transversely sequencing fashion across the lane for viewing by a player during a rolling of a bowling ball towards the standing pins;

sensing means operable at a predetermined position along the lane for sensing a bowling ball at a predetermined position; and a processor operable with the illuminating means and the sensing means for enhancing a bowling score initiated by the scoring means.

2. The apparatus according to claim 1, wherein the illuminating means comprise:

a light source carried above the lane, the light source projecting a plurality of light beams toward the lane for placing the series of images onto the surface of the lane as a series of spots of light; and switching means operable with the light source for triggering the light source in an on and off manner for illuminating the surface of the lane with the spots of light in the sequencing fashion.

3. The apparatus according to claim 2, wherein the light source is a laser.

4. The apparatus according to claim 1, wherein the illuminating means comprise:

a laser source carried above the lane, the laser source projecting a laser beam toward the surface of the lane for placing a spot of light thereon; and scanning means operable with the laser source for scanning the laser beam across the surface of the lane to thus provide the series of images as spots moving transversely across the lane.

5. The apparatus according to claim 4, further comprising a housing, wherein the laser source is carried by the housing, and wherein the housing comprises a transparent wall for transmitting the laser beam therethrough.

6. The apparatus according to claim 1, wherein the illuminating means comprise:

a plurality of light sources imbedded in the lane, the light sources extending transversely across the lane; and switching means operable with the light source for triggering the light source in an on and off manner for illuminating the surface of the lane with the series of images in the sequencing fashion.

7. The apparatus according to claim 1, wherein the sensing means comprise:

a transmitter extending a beam of light transversely across the lane; and a receiver operable with the transmitter for receiving the beam of light, wherein an interruption of the beam is indicative of a bowling ball at the predetermined position.

8. The apparatus according to claim 1, wherein the processor is responsive to a signal from the sensing means when a bowling ball is at the predetermined position and to a signal from the illuminating means when one of the series of images is illuminated for enhancing the scoring of the game based on a preselected combination of values for each position of the series of images on the surface of the lane.

9. The apparatus according to claim 1, further comprising a display having a series of lights representative of the series of images, wherein illumination of each of the series of lights is correlated with illumination of each of the series of images.

10. The apparatus according to claim 9, further comprising indicia carried by the display, which indicia provides a scoring value for each position of the series of images on the surface of the lane, and thus each of the series of lights displayed.

11. An apparatus useful in a game of bowling, the apparatus comprising:

illuminating means for illuminating a series of images in a transversely sequencing fashion across a surface of a bowling lane for viewing by a player during a rolling of a bowling ball towards standing pins;

sensing means for sensing a bowling ball at a predetermined position; and a processor operable with the illuminating means and the sensing means for enhancing a bowling score responsive to pins felled by a bowling ball.

12. The apparatus according to claim 11, wherein the illuminating means comprise:

a light source projecting the series of images as a plurality of spots of light on the surface of the lane; and switching means operable with the light source for illuminating the surface of the lane with the spots of light in the sequencing fashion.

13. The apparatus according to claim 12, wherein the light source is a laser.

14. The apparatus according to claim 11, wherein the illuminating means comprise:

a laser beam directed toward the surface of the lane for placing a spot of light thereon; and scanning means for scanning the laser beam across the lane.

15. The apparatus according to claim 11, wherein the illuminating means comprise:

a plurality of light sources imbedded in the lane; and switching means sequencing illumination of the series of light.

16. The apparatus according to claim 15, wherein each of the plurality of light sources comprises a laser source.

17. The apparatus according to claim 11, wherein the sensing means comprise:

a transmitter extending a signal across the lane; and a receiver operable with the transmitter for receiving the signal, wherein an interruption of the signal is indicative of a bowling ball at the predetermined position.

18. The apparatus according to claim 11, wherein the processor is responsive to a signal from the sensing means when the bowling ball is at the predetermined position and in combination to the illuminating means when one of the series of images is illuminated for enhancing a scoring of a game based on a preselected combination of values for each position of the series of images on the lane.

19. The apparatus according to claim 11, further comprising a display having a series of lights representative of the series of images, wherein illumination of each of the series of lights is correlated with illumination of each of the series of images.

20. The apparatus according to claim 19, further comprising indicia carried by the display, which indicia provides a scoring value for each position of the series of images on the lane, and thus each of the series of lights displayed.

21. An apparatus useful in a game of bowling, the apparatus comprising:

illuminating means for illuminating a series of images in a sequencing fashion for viewing by a player during the rolling of a bowling ball towards standing pins;

sensing means for sensing a bowling ball at a predetermined position; and a processor operable with the illuminating means and the sensing means for enhancing a bowling score responsive to pins felled by the bowling ball, the processor responsive to a bowling ball being at the predetermined position in combination with an image of the series of images being illuminated for enhancing a scoring of a game based on a preselected combination of values for each image of the series of images.

22. The apparatus according to claim 21, wherein the illuminating means comprise:

a light source projecting the series of images as a plurality of spots of light on a surface; and switching means operable with the light source for illuminating the surface with the spots of light in the sequencing fashion.

23. The apparatus according to claim 21, wherein the illuminating means comprise:

a laser beam directed toward a surface for placing a spot of light thereon; and sequencing means for sequencing a plurality of spots of light over the surface.

24. The apparatus according to claim 21, wherein the illuminating means comprise:

a plurality of light sources; and sequencing means for sequencing operation of the series of light sources.

25. The apparatus according to claim 21, wherein the sensing means comprise:

a transmitter extending a signal across the lane; and a receiver operable with the transmitter for receiving the signal, wherein an interruption of the signal is indicative of the bowling ball at the predetermined position.

26. The apparatus according to claim 21, further comprising indicia for providing a scoring value for each position of the series of images.

27. A method of scoring a bowling game using a bowling lane having an approach area at one end for permitting a player to roll a bowling ball generally longitudinally along a surface of the lane towards a plurality of standing pins positioned in a predetermined array on a pin deck at an opposing end of the lane, and a scoring device for scoring a game based on an amount pins felled by the bowling ball, the scoring method comprising the steps of:

illuminating a series of images in a transversely sequencing fashion across the lane on a surface thereof;

viewing the series of lights by the player;

rolling of a bowling ball towards the standing pins;

sensing the bowling ball as is reaches a predetermined position along the lane; and enhancing a bowling score responsive to the bowling ball being at the predetermined position when one of the series of images is illuminated, the enhancing based on a preselected combination of values for each position of the series of images on the surface of the lane.

28. The method according to claim 27, wherein the illuminating step comprises the steps of:

placing a light source above the lane;

projecting a plurality of light beams toward the lane for placing the series of images on the surface thereon as a series of spots of light; and switching the light source on and off for illuminating the surface of the lane with the spots of light in the sequencing fashion.

29. The method according to claim 27, wherein the illuminating step comprises the steps of:

projecting a laser beam toward the surface of the lane for placing a spot of light thereon; and scanning the laser beam across the lane to thus provide the series of images as a plurality of spots moving transversely across the lane on the surface thereof.

30. The method according to claim 27, wherein the illuminating step comprises the steps of:

imbedding a plurality of light sources in the lane; and switching the light sources on and off for illuminating the surface of the lane with the series of images in the sequencing fashion.

31. The method according to claim 27, wherein the sensing step comprises the steps of:

transmitting a beam of light transversely across the lane; and receiving the beam of light, wherein an interruption of the beam is indicative of the bowling ball at the predetermined position.

32. The method according to claim 27, further comprising the step of displaying a series of lights representative of the series of images, wherein the illuminating step is correlated with operating each of the series of lights.

33. The method according to claim 32, further comprising the step of displaying indicia representing a scoring value for each position of the series of images on the lane, and thus each of the series of lights displayed.

34. A method of scoring a bowling game, the method comprising the steps of:

illuminating a series of images in a transversely sequencing fashion across a surface of a bowling lane for viewing by a player during the rolling of a bowling ball towards standing pins;

sensing the bowling ball at a predetermined position; and enhancing a bowling score responsive to the bowling ball being at the predetermined position when one of the series of images is illuminated, the enhancing based on a preselected combination of values for each position of the series of images on the surface of the lane.

35. The method according to claim 34, wherein the illuminating step comprises the steps of:

projecting the series of images as a plurality of spots of light on the surface of the lane; and operating the light source for illuminating the surface of the lane with the plurality of spots of light in the sequencing fashion.

36. The method according to claim 34, wherein the illuminating step comprises the steps of:

directing a laser beam toward a surface of the lane for placing a spot of light thereon; and scanning the laser beam across the surface of the lane.

37. The method according to claim 34, wherein the illuminating step comprises the steps of:

imbedding a plurality of light sources in the lane; and operating the light sources for sequential illuminating thereof.

38. The method according to claim 34, wherein the sensing step comprises the steps of:

transmitting a signal across the lane;

receiving the signal; and interrupting the signal with the bowling ball as the bowling ball is rolled to the predetermined position.

39. The method according to claim 34, further comprising the step of displaying a series of lights representative of the series of images, wherein the illuminating step is correlated with operating each of the series of lights.

40. The method according to claim 39, further comprising the step of displaying indicia representing a scoring value for each position of the series of images on the lane, and thus each of the series of lights displayed.

41. A method of scoring a bowling game, the method comprising the steps of:

illuminating a series of images in a sequencing fashion for viewing by a player during a rolling of a bowling ball towards standing pins;

sensing the bowling ball at a predetermined position; and enhancing a bowling score responsive to the bowling ball being at the predetermined position when one of the series of images is illuminated, the enhancing based on a preselected combination of values for each position of the series of images on the lane.

42. The method according to claim 41, wherein the illuminating step comprises the steps of:

projecting a series of images as a plurality of spots of light on a surface; and sequentially moving the plurality of spots of light.

43. The method according to claim 41, wherein the illuminating step comprises the steps of:

directing a laser beam directed toward a surface for placing a spot of light thereon; and moving the spot of light over the surface.

44. The method according to claim 41, wherein the illuminating step comprises the step of:

providing a plurality of light sources; and sequencing operation of the plurality of light sources.

45. The method according to claim 41, wherein the sensing step comprises the steps of:

providing a sensing signal across the lane at the predetermined position; and interrupting the sensing signal with the bowling ball as the bowling ball reaches the predetermined position.

46. The method according to claim 41, further comprising the step of indicating a scoring value for each position of the series of images.

* * * * *